US012163260B1

(12) United States Patent
Geiwald et al.

(10) Patent No.: US 12,163,260 B1
(45) Date of Patent: Dec. 10, 2024

(54) HEATHER SPUN POLYESTER YARN AND FABRIC, AND METHOD FOR PRODUCING THE SAME

(71) Applicant: Winds Enterprises Limited, China Hong Kong (HK)

(72) Inventors: Paul Urban Geiwald, Encinitas, CA (US); Lean Teik Heng, Shanghai (CN); Yu Chung Lo, San Diego, CA (US)

(73) Assignee: Winds Enterprises Limited, China Hong Kong (HK)

( * ) Notice: Subject to any disclaimer, the term of this patent is extended or adjusted under 35 U.S.C. 154(b) by 57 days.

(21) Appl. No.: 17/581,503

(22) Filed: Jan. 21, 2022

Related U.S. Application Data

(63) Continuation of application No. 15/901,825, filed on Feb. 21, 2018, now abandoned.

(60) Provisional application No. 62/461,680, filed on Feb. 21, 2017.

(51) Int. Cl.

| | |
|---|---|
| ***D02G 3/34*** | (2006.01) |
| ***D01F 1/04*** | (2006.01) |
| ***D01F 6/62*** | (2006.01) |
| ***D02G 3/04*** | (2006.01) |
| ***D02G 3/38*** | (2006.01) |
| ***D02G 3/44*** | (2006.01) |
| ***D04B 1/16*** | (2006.01) |
| ***D04B 1/24*** | (2006.01) |
| ***D04B 21/16*** | (2006.01) |
| ***D04B 21/20*** | (2006.01) |
| ***D06P 3/52*** | (2006.01) |

(52) U.S. Cl.
CPC ..... *D02G 3/346* (2013.01); *D01F 1/04* (2013.01); *D01F 6/62* (2013.01); *D02G 3/045* (2013.01); *D02G 3/38* (2013.01); *D02G 3/44* (2013.01); *D04B 1/16* (2013.01); *D04B 1/24* (2013.01); *D04B 21/16* (2013.01); *D04B 21/207* (2013.01); *D06P 3/52* (2013.01); *D10B 2331/04* (2013.01)

(58) Field of Classification Search
CPC ..... D02G 3/045; D02G 3/346; D02G 3/38; D02G 3/44; D01F 1/04; D01F 6/62; D04B 1/16; D04B 1/24; D04B 21/16; D04B 21/207; D06P 3/52; D10B 2331/04
See application file for complete search history.

(56) References Cited

U.S. PATENT DOCUMENTS

| | | | | |
|---|---|---|---|---|
| 3,401,142 | A | 10/1968 | Bowman et al. | |
| 3,468,121 | A | 9/1969 | Katsunosuke | |
| 3,587,220 | A | 6/1971 | Eggleston | |
| 3,593,513 | A | 7/1971 | Reese | |
| 3,604,197 | A * | 9/1971 | Sekiguchi | D02G 3/346 28/281 |
| 3,676,906 | A | 7/1972 | Eggleston | |
| 3,681,910 | A | 8/1972 | Reese | |
| 3,829,543 | A | 8/1974 | Robertson | |
| 4,001,171 | A | 1/1977 | Khanna | |
| 4,222,223 | A | 9/1980 | Nelson | |
| 4,280,261 | A | 7/1981 | Nelson | |
| 4,295,329 | A | 10/1981 | Windley | |
| 4,521,585 | A | 6/1985 | Thomsen et al. | |
| 4,602,046 | A | 7/1986 | Buser et al. | |
| 5,188,892 | A | 2/1993 | Grindstaff | |
| 5,613,285 | A | 3/1997 | Chester et al. | |
| 6,383,635 | B1 | 5/2002 | King et al. | |
| 6,497,952 | B1 | 12/2002 | Ohkoshi et al. | |
| 7,070,624 | B2 | 7/2006 | Holmes, III et al. | |
| 7,818,982 | B2 | 10/2010 | Prickett | |
| 8,907,009 | B2 | 12/2014 | Otto et al. | |
| 2009/0173055 | A1 * | 7/2009 | Silver | D02G 3/04 57/400 |
| 2010/0112325 | A1 * | 5/2010 | Iwamoto | D01F 8/12 428/221 |
| 2011/0070422 | A1 | 3/2011 | Ammirati et al. | |
| 2011/0086225 | A1 | 4/2011 | Takagi et al. | |
| 2011/0133011 | A1 * | 6/2011 | Lee | B65H 54/026 264/103 |
| 2013/0177264 | A1 * | 7/2013 | Utterback | D02G 3/04 57/58.54 |

(Continued)

FOREIGN PATENT DOCUMENTS

| | | | |
|---|---|---|---|
| EP | 1 627 942 | A1 | 2/2006 |
| JP | 2000-282326 | A | 10/2000 |

OTHER PUBLICATIONS

Extended European Search Report issued in EP 14183743.5, dated Jan. 26, 2015, 6 pages.
EP Office action dated Nov. 21, 2018, issued in EP 14183743.5, 6 pages.
Unknown, Standard Guide for Heated System Surface Conditions That Produce Contact Burn Injuries, Designation: C 1055-99, Annual Book of ASTM Standards, vol. 04.06, pp. 1-8 (1999).

*Primary Examiner* — Shaun R Hurley
(74) *Attorney, Agent, or Firm* — FROST BROWN TODD LLP

(57) ABSTRACT

A spun heather yarn includes first pre-colored staple fibers comprising masterbatch-dyed first polyester fibers, and second pre-colored staple fibers comprising second polyester fibers dyed with a cationic dyestuff. A knitted heather fabric includes a plurality of the spun heather yarns knitted together to form the knitted heather fabric. The first and/or second pre-colored staple fibers may be substantially free of carbon black and carbon black derivatives. A method of manufacturing a spun heather yarn includes masterbatch-dying a first raw polyester material to prepare first pre-colored staple fibers, separately preparing a plurality of second pre-colored staple fibers by dyeing a plurality of uncolored staple fibers with a cationic dyestuff, and spinning the first and second pre-colored staple fibers together to form the spun heather yarn. The spun heather yarns may then be knitted together to form a heather fabric.

13 Claims, 2 Drawing Sheets

(56) References Cited

U.S. PATENT DOCUMENTS

| | | | | |
|---|---|---|---|---|
| 2015/0068254 | A1 | 3/2015 | Geiwald et al. | |
| 2015/0107214 | A1* | 4/2015 | Rudinger | D01F 11/00 57/259 |
| 2015/0122368 | A1* | 5/2015 | Poon | D03D 15/217 139/420 R |
| 2016/0002829 | A1* | 1/2016 | Lightman | D04H 1/04 19/65 R |
| 2018/0179672 | A1* | 6/2018 | Lau | D02G 3/04 |
| 2018/0179673 | A1* | 6/2018 | Lau | D01H 1/02 |

* cited by examiner

HEATHER SPUN POLYESTER YARN AND FABRIC, AND METHOD FOR PRODUCING THE SAME

CROSS-REFERENCE TO RELATED APPLICATION(S)

This application is a continuation of U.S. patent application Ser. No. 15/901,825 filed Feb. 21, 2018, which claims priority to and the benefit of U.S. Provisional Application Ser. No. 62/461,680, filed on Feb. 21, 2017 and titled BLEED-FREE HEATHER SPUN POLYESTER YARN AND FABRIC WITH LOW SOLAR THERMAL BUILDUP AND METHOD FOR PRODUCING THE SAME, the entire content of each of which is incorporated herein by reference.

BACKGROUND

Polyester is used extensively across various industries to make all manner of products, from fabrics for apparel and home furnishings to industrial components such as tire reinforcements, safety belts and conveyor belts. Given the widespread uses of polyester across these industries, manufacturing polyester fabrics in various different colors is extremely important. However, it is generally accepted that the only dyes capable of coloring the polyester are disperse dyes.

To dye a polyester fabric with a disperse dye, the dye particles are dispersed in a solution containing water and other additives and the fabric (as a whole) is submerged in the dye solution, which is heated to promote dye uptake by the fabric. However, as this process requires submersion of the fabric in a dye bath which is mostly water, this dyeing process results in a large of amount of water waste.

To save water, the polyester fibers used to make the fabric can alternatively be colored using a dope-dyeing method. In dope-dyeing, the polyester fibers achieve the desired color by adding organic and/or inorganic colored pigments to the polymer melt during the filament manufacturing process, i.e., the melt spinning filament extrusion process. In this dyeing process, different pigment compositions are used to achieve different colors and shades, but the color black is typically accomplished by pigment particles derived or extracted from carbon materials, e.g., carbon black. While these carbon-derived pigments may be suitable for certain applications, black pigments derived from carbon are known to absorb a significant amount of infrared radiation, which causes the surface temperature of the material containing the pigment to reach very hot temperatures under direct sunlight. For example, on a bright sunny day, materials dope-dyed with carbon black or its derivatives can reach temperatures well over 60° C./140° F. If these materials are in direct contact with skin, these high temperatures can cause thermal burns, as discussed in "Standard Guide for Heated System Surface Conditions That Produce Contact Burn Injuries," published by the American Society for Testing and Materials (ASTM), a copy of which was attached as an Appendix to the U.S. Provisional Application No. 62/461,680 filed on Feb. 21, 2017 to which this application claims priority, the entire content of which is incorporated herein by reference (and hereafter referred to as the "ASTM publication"). As reported in the ASTM publication, "[t]he lowest temperature where epidermis (outside skin layer) damage occurs is approximately 44° C. [or 111.2° F.] when it is sustained for approximately 6 [hours]." ASTM publication, page 5, paragraph X1.2.3.2. Additionally, "[a]s temperatures of contact increase above 44° C., the time to damage is shortened by approximately 50% for each 1° C. rise in temperature up to about 51° C." ASTM publication, page 5, paragraph X1.2.3.4. As can be seen from this, a person wearing a t-shirt containing a carbon black colored fabric could experience thermal burns to the skin on a bright sunny day. Specifically, as the temperature of the carbon black dyed fabric can reach 60° C./140° F. over time, and as damage to the skin occurs at temperatures significantly lower than that (i.e., at 44° C. or even lower), the wearer's skin could be thermally burned within a matter of only a few hours.

Despite this danger, a suitable alternative to dyeing wearable fabrics to a true black color has not yet been developed. While solvent dyestuffs may be used as an alternative to carbon black pigments, these dyes are known to result in color migration due to dye sublimation, a phenomenon known as color "bleeding." This problem commonly occurs in screen printing a white logo onto a darker colored fabric. For example, if a white logo is screen printed on a red polyester fabric dyed with a solvent dyestuff, the red color will sublimate from the fibers through the white screen printing ink and turn the white logo pink. Such color "bleeding" due to dye sublimation during printing is considered unacceptable in the textile industry, but it nonetheless occurs, necessitating application of an anti-migration layer and a flashing step prior to printing the logo. This makes the printed logo very thick and stiff.

SUMMARY

According to embodiments of the present disclosure, a spun heather yarn includes first pre-colored staple fibers comprising masterbatch-dyed first polyester fibers, and second pre-colored staple fibers comprising second polyester fibers dyed with a cationic dyestuff. The first and second pre-colored staple fibers are spun together to form the spun heather yarn. In some embodiments, the spun heather yarn may further include third pre-colored staple fibers, which include third polyester fibers that are either masterbatch-dyed or dyed with a cationic dyestuff. The third pre-colored staple fibers are spun together with the first and second pre-colored staple fibers to form the spun heather yarn.

In some embodiments of the disclosure, a knitted heather fabric includes a plurality of the spun heather yarns knitted together to form the knitted heather fabric. Because the staple fibers used to form the spun heather yarn are all polyester, the knitted heather fabric may be 100% polyester. In some embodiments, however, the spun heather yarns disclosed herein can be combined with other materials (e.g., Spandex) to form the knitted heather fabric. According to some embodiments, to create a heather effect with more than two colors, a knitted heather fabric may include a plurality of the spun heather yarns having first, second and third pre-colored staple fibers knitted together to form the knitted heather fabric.

According to embodiments of the present disclosure, the first pre-colored staple fibers are substantially free of carbon black and carbon black derivatives. Additionally, in general, the first and second staple fibers may have any desired color. In some embodiments, however, the first pre-colored staple fibers may be a color other than black, and in some embodiments, the second pre-colored staple fibers may be black in color.

According to embodiments of the present disclosure, an article of clothing includes a knitted fabric knitted from the spun polyester yarns disclosed herein. The article of clothing may take any suitable shape, for example, shirts, pants, shorts, undergarments, socks, etc. In some embodiments, however, the article of clothing is designed or configured for direct contact with the wearer's skin. In some embodiments, the article of clothing is substantially or completely free of carbon black and carbon black derivatives.

A method of manufacturing a spun heather yarn according to embodiments of the present disclosure includes preparing a plurality of first pre-colored staple fibers by masterbatch-dying a first raw polyester material, separately preparing a plurality of second pre-colored staple fibers by dyeing a plurality of uncolored staple fibers with a cationic dyestuff, and spinning the plurality of first pre-colored staple fibers together with the plurality of second pre-colored staple fibers to form the spun heather yarn. The method may further include preparing a plurality of third pre-colored staple fibers by masterbatch-dying a third raw polyester material, and/or separately preparing a plurality of fourth pre-colored staple fibers by dyeing a plurality of additional uncolored staple fibers with a different cationic dyestuff. In embodiments with third and/or fourth staple fibers, the spinning comprises spinning the first pre-colored staple fibers and the second pre-colored staple fibers with the third pre-colored staple fibers and/or the fourth pre-colored staple fibers to form a spun heather yarn having three or more colors.

In some embodiments, masterbatch-dying the first raw polyester material includes mixing the first raw polyester material with a masterbatch dye composition to form an extrusion mixture, melting the extrusion mixture to form an extrusion melt, extruding the extrusion melt to form masterbatch-dyed polyester filaments, and cutting the masterbatch-dyed filaments to form the first pre-colored staple fibers. According to some embodiments, the masterbatch dye composition may include a carrier and a pigment, and in some embodiments, the masterbatch dye composition may further include a surfactant. The carrier may include an organic solvent and/or a resin. In some embodiments, the pigment is substantially free of carbon black and carbon black derivatives.

Separately preparing the plurality of second pre-colored staple fibers may include combining the plurality of uncolored staple fibers with water to form a fiber bath, adding a cationic dyestuff to the fiber bath to form a dye bath, heating the dye bath, and removing the water from the dye bath to yield the plurality of second pre-colored staple fibers.

According to embodiments of the present invention, a method of making a knitted heather fabric includes knitting a plurality of the spun heather yarns together to form the knitted heather fabric.

BRIEF DESCRIPTION OF THE DRAWINGS

These and other features and advantages of embodiments of the present disclosure will be better understood with reference to the following detailed description when considered in conjunction with the accompanying drawings, in which.

DETAILED DESCRIPTION

Figure 1:
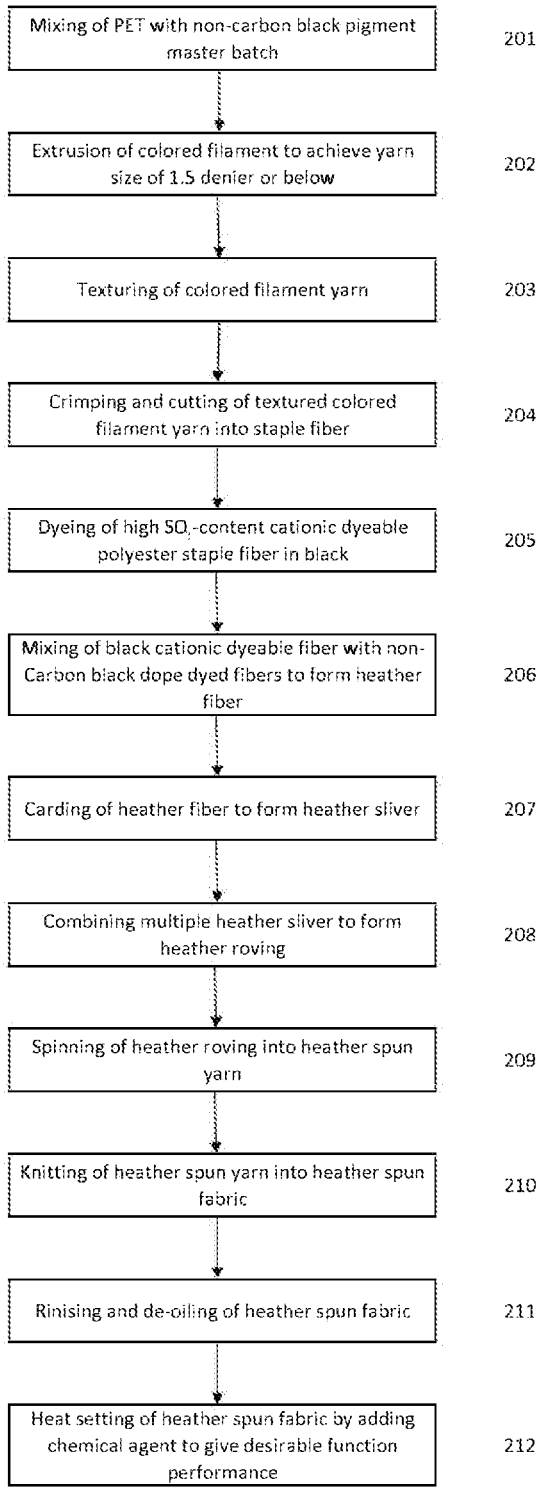
FIG. 1 is a flow chart illustrating a method of making a polyester heather fabric according to embodiments of the present invention.

Conventional spun polyester heather fabrics are typically manufactured by knitting together two different yarns (e.g., colored polyester yarns and uncolored (or raw) polyester yarns) or knitting together yarns made of blended fibers (e.g., colored polyester fibers and uncolored (or raw) polyester fibers) to form a completed textile or fabric that includes both the colored yarns (or colored fibers) and the uncolored yarns (or uncolored fibers) in a weave pattern. This knitted fabric is then dyed as a single piece in a bath of dye solution. The uncolored yarns (or uncolored fibers) in the knitted fabric can be subjected to a dye procedure by submersion in a dye bath using a disperse dye to color the uncolored polyester yarns (or uncolored fibers).

This conventional process for heather fabric dyeing has several drawbacks. First, dyeing the fabric after knitting requires a significant amount of water in the dye bath in order to properly saturate the fabric with the dye solution. Second, because the heather fabric is dyed after knitting, heather effects of only two different colors can be achieved.

According to embodiments of the present disclosure, a spun heather yarn (also referred to herein interchangeably as a "spun polyester heather yarn" or a "polyester heather yarn") includes first pre-colored staple fibers comprising masterbatch-dyed first polyester fibers, and second pre-colored staple fibers comprising second polyester fibers dyed with a cationic dyestuff. The first and second pre-colored staple fibers are spun together to form the spun heather yarn. In some embodiments, the spun heather yarn may further include third pre-colored staple fibers, which include third polyester fibers that are either masterbatch-dyed or dyed with a cationic dyestuff. The third pre-colored staple fibers are spun together with the first and second pre-colored staple fibers to form the spun heather yarn. It is understood, however, that the spun heather yarns according to embodiments of the present disclosure can include any number of different pre-colored staple fibers. As such, although first, second and third pre-colored staple fibers are mentioned here, any number of more than three different pre-colored staple fibers may be sued to create a spun heather yarn including multiple colors (e.g., 2 or more, or 3 or more colors. When the spun heather yarn is made from 3 or more pre-colored staple fibers, the third, fourth, etc. pre-colored staple fibers may be pre-colored or dyed by any suitable means, e.g., by masterbatch-dyeing or by dyeing with a cationic dyestuff.

Indeed, in some embodiments of the present disclosure, a polyester heather yarn and/or fabric (also referred to herein interchangeably as a "spun polyester heather yarn") includes a blend of at least first pre-colored polyester fibers (or staple fibers) and second pre-colored polyester fibers (or staple fibers). In some embodiments, the first and second pre-colored polyester fibers may be dyed using different dyeing techniques. For example, in some embodiments, the first pre-colored polyester fibers may be dyed by a masterbatch process (also referred to herein, interchangeably as a "masterbatch dyeing process" or similar term), and the second pre-colored polyester fibers may be dyed by a cationic dyestuff (also referred to herein, interchangeably, as a "bath dyeing process" or similar term). In some exemplary embodiments, the first pre-colored polyester fibers may be dyed by a masterbatch process using a substantially carbon-free pigment or colorant, and second polyester fibers dyed by a cationic dyestuff. This blend of polyester fibers dyed using different dye chemistries and dyeing methods enables the production of polyester heather fabrics that avoid (or reduce) both solar thermal build-up and dye sublimation issues common in spun polyester heather products currently on the market.

Additionally, unlike conventional heather fabrics, according to embodiments of the present invention, the heather fabric may include only fibers of the same material, e.g., polyester. For example, according to embodiments of the present disclosure, a heather fabric or textile can be 100% polyester while also having a heather coloring effect. Indeed, because the heather fabrics according to embodiments of the present invention include pre-colored polyester fibers that are knitted after dyeing, and that are dyed by different techniques, all fibers used in the heather fabric can be polyester.

Contrary to conventional heather fabrics, the heather fabrics according to embodiments of the present disclosure can also include more than two different colors contributing to the heather effect. Specifically, because the heather fabrics are knitted from pre-colored polyester fibers, the fabrics can be knitted using any number of differently colored fibers.

As used herein, the term "substantially" is used as a term of approximation, and not as a term of degree, and is intended to account for the possibility of incidental impurities in the listed component. For example, the term "substantially free of carbon" refers to a composition that does not include added carbon or carbon components or materials, and refers to the inclusion of any carbon or carbon components or materials in the pigment or colorant only as incidental impurities in negligible amounts that do not contribute to the function or properties of the pigment or colorant. In contrast, a composition that is "free of carbon" or "completely free of carbon" contains no measurable amount of carbon or carbon components or materials.

Additionally, as used herein, the term "carbon" (e.g., in the term "substantially free of carbon") is not intended to denote all materials that include C atoms as part of the chemical formula, but rather denotes materials that are commonly referred to as "carbonaceous materials," which are rich in carbon or contain carbon as the primary or main ingredient, and which are known for use as pigments or colorants. Some examples of these types of carbonaceous materials include graphitic carbon and carbon materials derived from petroleum products. One common carbon material or carbonaceous material fitting this definition is carbon black. However, the term "carbon" in the context of this application is not intended to encompass all organic materials that include a backbone of C and H atoms, as would be understood by those of ordinary skill in the art.

Further, as used herein, the term "pre-colored" refers to the coloring or dyeing of the polyester fibers (or staple fibers) before the fibers are knitted or spun into a fabric or textile. Accordingly, the "pre-colored" polyester fibers discussed herein are dyed or colored while in the fiber form, and are spun into a heather yarn and then knitted into a textile or fabric after the coloring or dyeing procedure. This enables the production of spun heather yarns and heather fabrics or textiles having more than two colors. Indeed, because the fibers are colored before spinning and knitting, the end yarn and fabric may have any number of different colors contributing to the heather effect, including 3 or more colors.

According to embodiments of the present disclosure, a heather yarn may be formed by blending the first polyester fibers dyed by a masterbatch process using a substantially carbon-free pigment or colorant, and second polyester fibers dyed by a cationic dyestuff. Similarly, in some embodiments, a heather fabric may be formed by spinning the heather yarns, or by spinning and knitting the first and second staple fibers together. The first and second polyester fibers dyed by a cationic dyestuff may be any desired color, including black and all other colors. However, both the first and second polyester fibers achieve color using a pigment, colorant or dye that is substantially free, or in some embodiments completely free, of carbon (e.g., carbon-based pigments, colorants or dyes).

Additionally, in some embodiments, the heather yarn and/or fabric may be made with second fibers (dyed by a cationic dyestuff) that are black in color (using a dye that is substantially or completely free of carbon), and first fibers that are non-black (using pigments or colorants that are also substantially free of carbon). As used herein, the term "non-black" refers to any color that is not true black, and encompasses faded black colors and all shades of gray, as well as all other colors that those of ordinary skill in the art would not classify as true black. As the black second polyester fibers are dyed via cationic dyestuffs that are not derived from (or are substantially free of) carbon or carbonaceous materials, yarns and fabrics made using non-black first fibers (dyed via masterbatch dyeing) and black second fibers (dyed via cationic dyestuffs) avoid (or reduce) infrared absorption and solar thermal build-up.

In the heather yarns and/or fabrics according to embodiments of the present disclosure, the cationic dyestuffs used to color the second fibers form strong ionic bonds with cationic low temperature dyeable polyester materials. These strong ionic bonds create a colorfast textile that is substantially bleed-free even after high temperature exposure. For example, the heather fabrics according to embodiments of the present disclosure achieve grade 4.5 in each of color fastness to dry heat (American Association of Textile Chemists and Colorists, "AATCC" 117), color fastness to washing (AATCC 61-2A), and color fastness to dye transfer (AATCC 160). In addition, because the pigments or colorants used in the first fibers (i.e., the masterbatch dyed staple fibers) are melted and extruded with the polyester, the first fibers are inherently colorfast. The first fibers also generally do not sublimate under high temperatures since the pigment or colorant is cured into the first (masterbatch dyed) fibers. Therefore, blending the first and second staple fibers dyed by these two different chemistries and techniques form unique heather yarns and textiles (or fabrics) that are both bleed-free and experience low thermal build-up.

In addition, according to embodiments of the present disclosure, heather fabrics can achieve the desired color using significantly less water than conventionally required for currently available heather textiles. In particular, as discussed above, conventional spun heather fabrics are prepared by knitting together two different yarns (e.g., colored polyester yarns and uncolored (or raw) polyester yarns) or knitting together yarns made of different fibers (e.g., colored fibers and uncolored (or raw) fibers) to form a completed textile or fabric that includes both the colored yarns (or colored fibers) and the uncolored yarns (or uncolored fibers) in a weave pattern. This knitted fabric is then dyed as a single piece in a bath of dye solution, which contains the dye material and other additives, but is mostly water. In significant contrast, according to embodiments of the present disclosure, the first staple fibers are inherently colored by virtue of the pigment or colorant being melted and extruded with the polyester material of the fibers. Additionally, the second staple fibers are dyed prior to spinning the second fibers with the first fibers to form the spun heather yarn, and prior to knitting or weaving the yarns into a fabric or textile. Indeed, the second staple fibers (and not the finished textile) are submerged in the dye bath. This saves a significant amount of water compared to the conventional textile dyeing process because the fiber dyeing process according to embodiments of the present disclosure only requires a fiber/liquid ratio of about 1:5.5 to about 1:6.5, or about 1:6. This means that for each 1 kilogram of fibers, only about 5.5 to about 6.5, or about 6 kilograms of liquid (which is mostly water, but also includes the dyestuff, and other chemical agents and/or additives for facilitating dye uptake) is needed to effect sufficient dye uptake and coloring. However, the conventional dyeing method (in which the fabric or textile is submerged in the bath as a single piece) requires a fabric/bath ratio of 1:10 to 1:20. This means that to dye the same weight of fabric (e.g., 1 kilogram), the conventional method requires 10 to 20 kilograms of bath liquid rather than the about 5.5 to about 6.5, or about 6 kilograms used in embodiments of the present disclosure.

As can be seen from this comparison, the dyeing methods according to embodiments of the present disclosure achieve water savings compared to the conventional technique of at least about 35% to about 72.5%, about 45% to about 72.5%, about 35% to about 67.5%, or about 40% to about 60%. In some embodiments, for example, the dyeing methods according to embodiments of the present disclosure achieve water savings compared to the conventional technique of about 35%, about 40%, about 45%, about 60%, about 67.5%, or about 72.5%. However, as discussed further below, because the dyeing methods according to embodiments of the present disclosure dye the staple fibers themselves (i.e., prior to spinning and knitting), only half of the staple fibers (i.e., the second staple fibers) need to be dyed by the bath dye process. As such, to produce the same knitted fabric, the conventional process requires a liquid amount based on the total weight of the fabric, while the methods according to the present disclosure require a liquid amount based on half the weight of the fabric (i.e., the weight of only the second fibers). Consequently, while the conventional method requires 10 to 20 kilograms of liquid to dye a 1 kilogram fabric, the methods according to the present disclosure use only about 2.75 to about 3.75 kilograms of liquid, or about 3 kilograms of liquid. This represents an even more significant water savings compared to the conventional technique of about 62.5% to about 86.25%, or about 70% to about 85%. In some embodiments, for example, the dyeing methods according to the present disclosure may achieve water savings compared to the conventional methods of about 62.5%, about 70%, about 72.5%, about 81.25%, about 85%, or about 86.25%.

According to embodiments of the present disclosure, a method of making a heather fabric or textile utilizes the water-saving, colorfast benefits of masterbatch dyeing staple fibers, while also avoiding (or reducing) the thermal build-up commonly seen in fabrics containing carbon-derived pigments or colorants, e.g., carbon black and related pigments or colorants. This unique blending of the first and second pre-colored polyester fibers dyed according to different fiber coloring methods provides a comfortable-to-touch performance textile material.

A method of manufacturing a spun heather yarn according to embodiments of the present disclosure includes preparing a plurality of first pre-colored staple fibers by masterbatch-dying a first raw polyester material, separately preparing a plurality of second pre-colored staple fibers by dyeing a plurality of uncolored staple fibers with a cationic dyestuff, and spinning the plurality of first pre-colored staple fibers together with the plurality of second pre-colored staple fibers to form the spun heather yarn. The method may further include preparing a plurality of third pre-colored staple fibers by masterbatch-dying a third raw polyester material, and/or separately preparing a plurality of fourth pre-colored staple fibers by dyeing a plurality of additional uncolored staple fibers with a different cationic dyestuff. In embodiments with third and/or fourth staple fibers, the spinning comprises spinning the first pre-colored staple fibers and the second pre-colored staple fibers with the third pre-colored staple fibers and/or the fourth pre-colored staple fibers to form a spun heather yarn having three or more colors.

In some embodiments, masterbatch-dying the first raw polyester material includes mixing the first raw polyester material with a masterbatch dye composition to form an extrusion mixture, melting the extrusion mixture to form an extrusion melt, extruding the extrusion melt to form masterbatch-dyed polyester filaments, and cutting the masterbatch-dyed filaments to form the first pre-colored staple fibers. According to some embodiments, the masterbatch dye composition may include a carrier and a pigment, and in some embodiments, the masterbatch dye composition may further include a surfactant. The carrier may include an organic solvent and/or a resin. In some embodiments, the pigment is substantially free of carbon black and carbon black derivatives.

Separately preparing the plurality of second pre-colored staple fibers may include combining the plurality of uncolored staple fibers with water to form a fiber bath, adding a cationic dyestuff to the fiber bath to form a dye bath, heating the dye bath, and removing the water from the dye bath to yield the plurality of second pre-colored staple fibers.

As shown in FIG. 1, a method of making a polyester heather fabric includes mixing or combining raw polyester material (e.g., chips, flakes, or any other suitable shapes) with a pigment or colorant (201) to form an extrusion mixture. The pigment or colorant may be mixed with the raw polyester material in any suitable amount. However, in some embodiments, the pigment or colorant may be present in the extrusion mixture in an amount of, for example, about 3 wt % (3% by weight) or less. Conversely, the raw polyester material may be present in the extrusion mixture in any suitable amount, for example, about 97 wt % or greater.

The pigment or colorant in the extrusion mixture in the masterbatch dyeing process may be a masterbatch material. As used herein, the term "masterbatch" is used in its art recognized sense to refer to a solid colorant product in which a pigment or colorant is dispersed. Indeed, as would be understood by those of ordinary skill in the art, a "masterbatch" is generally a solid plastic, rubber or elastomeric carrier in which a pigment or colorant is dispersed. The masterbatch material combined with the raw polyester material may be selected such that the carrier material of the masterbatch product is compatible with the raw polyester material in the mix or combination. For example, in some embodiments, the raw polyester material may include polyethylene terephthalate (PET), in which case, the carrier of the masterbatch material may also be PET or another material that is compatible with PET.

According to some embodiments, the pigment or colorant is substantially free of carbon, as that term is defined herein. For example, when a masterbatch material is used, the masterbatch may include any suitable carrier, but includes a pigment or colorant that is substantially free of carbon. In some embodiments, for example, the masterbatch material includes a pigment or colorant that is not carbon black or derived from carbon black. The use of pigments, colorants or masterbatches that do not include carbon black or materials derived from carbon black enables the production of a fabrics exhibiting significantly reduced or non-existent thermal build-up and that do absorb significantly less infra-red radiation under direct sunlight. To further reduce or eliminate the risk of contamination by carbon black or carbon black derived products, an extrusion machine that has only been used with solvent dyes may be utilized.

To mix or combine the raw polyester material with the pigment or colorant (e.g., the masterbatch material), these components may be added to a tank or vessel and mixed to distribute the pigment or colorant in the polyester chips. After mixing, the combined polyester and pigment are extruded (202) to form pre-colored polyester filaments or yarns. According to embodiments of the present disclosure, to achieve a homogeneous dispersion of pigment particles in the polyester melt, the extrusion process is engineered to overcome the intermolecular forces between the pigments. Additionally, to aid in the dispersion process, before mixing the pigment or colorant (e.g., the colored masterbatch) with the raw polyester (e.g., PET) chips and performing the extrusion, the pigment (e.g., masterbatch) may be adjusted or otherwise formulated to promote dispersion of the colored particles.

Masterbatch products are commercially available, and any suitable such commercial masterbatch product may be used in the embodiments disclosed herein. Those of ordinary skill in the art would be readily capable of selecting an appropriate masterbatch product based on the desired color of the first staple fibers. In general, however, some exemplary formulations of the pigment (or masterbatch) include a grinding vehicle (or carrier, as discussed above), a pigment, and a surfactant. As used herein, the term "grinding vehicle" refers to the liquid phase (or carrier) of the pigment dispersion (or masterbatch), which can include a resin, water, an organic solvent, or a combination of two or more of these three materials. However, water-based pigment dispersions (or water-based masterbatches) are generally not desired as these would compromise high heat sublimation resistance and result in reduced colorfastness performance. Indeed, when water based-dispersion pigments are subject to temperatures above the boiling point of water (100° C.), the dyestuffs typically transition to the gas phase and are thus removed from the extruded filament. This sublimation causes color shift during the fabric finishing process, or "bleeding" during screen printing, which results in undesirable coloring and aesthetics. Therefore, according to embodiments of the present invention, non-water-based pigment dispersions are used in which the carrier is an organic solvent, a resin, or a combination of the two.

In addition, in some suitable masterbatch products according to embodiments of the present disclosure, the pigments may be broken down (or ground) to primary particles. Different pigment colors have different sizes and chemistries, and therefore can require different methods of grinding to separate the particles and ensure proper or sufficient dispersion in the polymer melt. These methods include high-speed mixing, applying heat and shear, as well as milling methods for pigments requiring a greater amount of shear. Those of ordinary skill in the art would be capable of selecting an appropriate grinding technique based on the pigment selected for the polymer melt.

Once the pigments are broken down and separated, some suitable masterbatch products available on the market and suitable for use in embodiments of the present invention add a surfactant to stabilize the particles in the polymer melt and maintain the dispersion. The surfactant may include both hydrophilic and hydrophobic ends, and may surround the pigments to create a barrier. This allows the pigments to remain dispersed in the carrier, which prevents (or reduces) flocculation, aggregation and agglomeration.

In typical masterbatch products available on the market and suitable for use in embodiments of the present disclosure, the polyester (e.g., PET) chips and the pigment (e.g., masterbatch) may be mixed and dehydrated to remove excess water content. This process aids in achieving the desired color from the extrusion process. The dehydration process and temperature are not particularly limited, and those of ordinary skill in the art would be capable of selecting an appropriate dehydration temperature or process based on the composition of the polyester chips (or flakes) and the pigment or colorant.

The mixed and dehydrated polyester (e.g., PET) chips and pigment (e.g., masterbatch) may then be poured into the hopper of an extrusion machine, and subjected to the extrusion process. During the extrusion process (202), the polyester chips and the pigment are melted at a temperature sufficient to fully or completely melt the polyester and the pigment. Any suitable temperature may be used to achieve this melting, and the temperature may vary depending on the polyester material used or the pigment material used. Those of ordinary skill in the art are capable of selecting an appropriate temperature for the melting process based on the selection of the polyester and pigment materials. However, in some embodiments, the melting process may be carried out at a temperature ranging from about 260° C. to about 285° C.

Once the polyester and pigment chips are completely melted, the melt is extruded at a sufficient extrusion temperature from the spinneret in the form of colored filaments. Any suitable extrusion temperature may be used, and the temperature may vary depending on the polyester material used or the pigment material used. Those of ordinary skill in the art are capable of selecting an appropriate temperature for the extrusion process based on the selection of the polyester and pigment materials. However, in some embodiments, the extrusion temperature may be about 270° C. to about 285° C. The colored polyester filaments come together after being extruded to form polyester yarn known as POY (partially oriented yarn). The size and number of holes in the spinneret plate determine the size (denier) and the number of filaments within a polyester yarn.

To achieve a more comfortable hand feel in the finished fabric, the filaments may have a size of lower than 2.0 denier, for example about 1.5 denier or lower, or about 0.5 denier to about 1.5 denier. Conventional polyester filaments colored with pigments (other than black) in the melt are usually too coarse (i.e., 2.0 denier or greater) due to the need for either high pigment dosages in the masterbatch or high dosages of the pigment masterbatch in the melt in order to achieve dark or bright colors. This is because pigments that do not use carbon black or carbon black derived materials are not as bright or deep compared to solvent dyes. Also, because pigments have larger molecule sizes compared to cationic (or solvent) dyestuff molecules, pigments (or masterbatches) are actually considered "impurities" in the extruded polyester filament. Accordingly, the higher the dosage of pigment in the masterbatch, or the higher the dosage of the masterbatch in the extrusion melt, the more difficult it is to extrude finer filaments. This is due to the difficulty in forming proper polyester polymers because of the presence of too many pigment particles, which cause the filaments to break.

Filaments currently available on the market that are produced by extrusion methods using pigments are usually limited to sizes of 2.0 denier or greater, which is generally considered unsuitable for use in garment textiles. Filaments coarser than 2.0 denier do not account for bunching between colored pigments (often referred to as aggregates, agglomerates, and flocculates) in the polyester melt when manufacturing fibers below 1.5 denier. This phenomenon occurs as a result of intermolecular forces between pigment particles responsible for giving the filament the desired color. When pigments uncontrollably bunch together, the filament is extruded with uneven color. When such unevenly colored yarn is knitted into a fabric, "barre" (i.e., undesirable striping) occurs in the fabric, and this is generally unacceptable in the apparel textile industry. This unevenness in color becomes even more apparent when extruding filaments of finer deniers (1.5 denier and lower), making the extrusion process and the dispersion of pigment particles important. According to embodiments of the present invention, the method for extruding polyester colored with pigment in the melt (e.g., masterbatch colored with pigment) results in homogeneous color in the filament, and enables filaments having a denier of 1.5 and below, thereby preparing filaments that are suitable for use in apparel textiles.

Once the colored filaments are extruded, they may be oiled and drawn to achieve the desired strength. Oiling and drawing are processes well known to those of ordinary skill in the art, and those ordinary artisans would be readily capable of oiling and drawing the extruded filaments described herein. The process of drawing strengthens the polyester by aligning the polymer molecular chains in the fibers, thereby converting the yarn from POY (Partially Oriented Yarn) to FDY (Fully Drawn Yarn). After the filament yarn is drawn and the molecular chains aligned, the yarn may be textured (203) to achieve the desired performance & hand feel of the finished fabric. For a majority of textile applications, the FDY yarn will go through a specified texturing process in order to increase the bulkiness, porosity, softness, and/or elasticity. The colored polyester filament according to embodiments of the present invention can be textured via any suitable texturing technique, some non-limiting examples of which include false-twist, air-jet, stuffer box, and knit-de-knit.

The textured colored yarn may then be heated, crimped and cut into staple fibers (204). Heating, crimping and cutting filaments into stable fibers are processes well known to those of ordinary skill in the art, and those ordinary artisans would be readily capable of adopting appropriate techniques and parameters to accomplish the desired staple fibers from the filaments disclosed herein. The crimping process may involve heat setting the yarn to create crimps that facilitate the subsequent yarn spinning process. The crimped yarn may then be cut into colored staple fibers of generally equal length. The filaments may be cut to staple fibers having any suitable length, which may vary depending on the desired end use of the staple fibers. However, in some embodiments, the staple fibers have a length of about 38 mm to about 52 mm. Staple fibers of different lengths may be used to form yarns that achieve a different hand feel, appearance or physical performance such as pilling resistance, yarn strength, etc.

The staple fibers prepared as discussed above by extruding a melt including both raw polyester material (e.g., chips, flakes, etc.) and a pigment (e.g., a masterbatch) that is substantially or completely free of carbon black or carbon black derivatives may be knitted together to form a fabric of uniform color (e.g., a fabric using only the first staple fibers, and not having a heather coloring effect). Because the fabric is knitted from staple fibers that are substantially free of carbon black or carbon black derivatives, the fabric exhibits low to non-existent thermal build-up and reduced to non-existent dye sublimation. Accordingly, in some embodiments, the fabric knitted from these first staple fibers that are substantially free of carbon black or carbon black derivatives can be further processed into an article of clothing or apparel. For example, in some embodiments, the article of clothing may be an article intended or configured to contact the skin, such as shirts, pants, undergarments, socks, etc. Additionally, in some embodiments, the staple fibers used to make the fabric of the article of clothing or apparel may be black in color, but is substantially or completely free of carbon black or carbon black derivatives. As such, according to some embodiments, the article of clothing is substantially or completely free of carbon black and carbon black derivatives.

In some alternative embodiments, as discussed above, a heather yarn or fabric may be made by combining the first staple fibers produced according to the above extrusion method with the second staple fibers colored using a non-masterbatch process, such as, for example, by submersion in a bath of a cationic dyestuff. In some embodiments, for example, to achieve a black heather polyester yarn or fabric with low solar thermal buildup, the second staple fibers (dyed via a cationic dyestuff) may be black in color and the first staple fibers (dyed via extrusion of melt including a pigment) may be non-black (as that term is defined herein) or a color other than black. The second staple fibers are neither colored during the extrusion process (like the first staple fibers) nor colored with a pigment or dyestuff that includes carbon black or a carbon black derivative.

Instead, the second staple fibers are dyed via bath dye process in which the fibers are submerged in a bath containing a cationic dyestuff. In embodiments in which the second staple fibers are black in color, the dye bath includes a dyestuff for achieving the black color that is substantially or completely free of carbon black or derivatives of carbon black.

Additionally, unlike conventional processes for achieving the heather color effect which dyes the fabric after knitting, according to embodiments of the present invention, the second staple fibers are dyed before knitting together with the first staple fibers. As such, while the dyeing process for the second staple fibers according to embodiments of the present invention relies on a bath dye process using a cationic dye, the second staple fibers are dyed in fiber form prior to knitting into a fabric. This process significantly reduces the amount of water needed to dye a textile or fabric, and enable the creation of heather effects with 3 or more colors.

To produce the second polyester staple fibers, a raw cationic dyeable polyester staple fiber may be used. Any suitable cationic dyeable polyester staple fiber may be used. In some embodiments, for example, when a black color is desired, in order to achieve a black color that is rich and dark (e.g., having a CMC L value of 18 or below), the raw cationic dyeable polyester fiber may contain no less than 2.3% of $SO_3^-$ content by weight is used. The higher the percentage of $SO_3^-$ content in the second staple fibers, the more anionic dye sites there are to help attach more cationic dyestuff molecules, thereby achieving a richer and darker tone of black.

Figure 2:
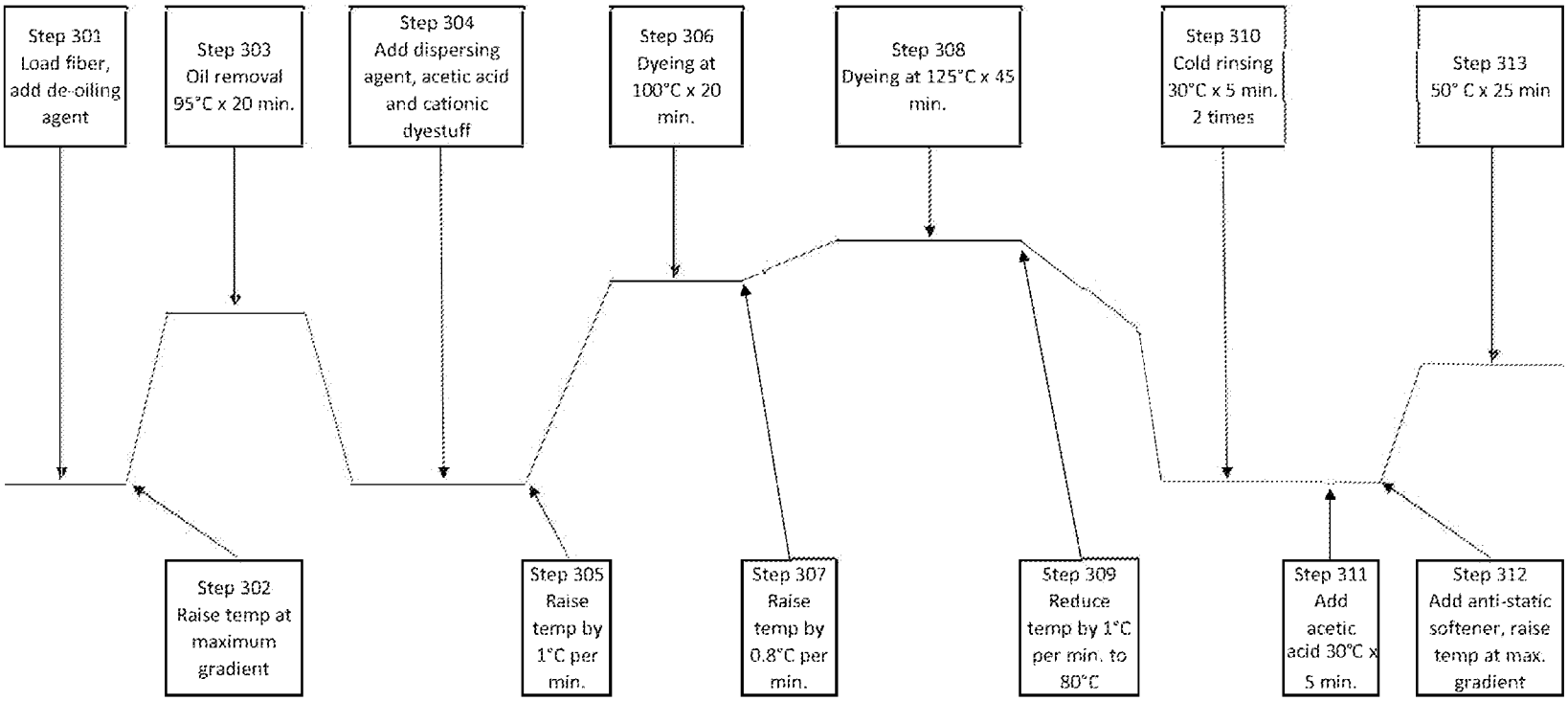
FIG. 2 is a flow chart illustrating a method of dyeing polyester fibers using a cationic dyestuff according to embodiments of the present invention.

As shown in FIG. 2, to dye the second staple fibers (205), first bales of raw cationic dyeable polyester staple fibers are unpacked. The loose fibers are then loaded into a dyeing basket of a fiber dyeing machine (301), and weighed to ensure that the weight of the fibers and the weight of the water used to dye the fibers satisfies an appropriate ratio. For example, as discussed above, the weight ratio of the fibers to the water may be about 1:5.5 to about 1:6.5, for example, about 1:6. Water may then be sprayed onto the second staple fibers, and the second staple fibers may be spread loosely and evenly inside the dyeing basket to facilitate optimal dye uptake. The dyeing basket may then be loaded into the fiber dyeing machine.

Once the second staple fibers are inside the dyeing machine, water is filled into the machine until it reaches the desired fiber to liquid ratio, e.g., about 1:5.5 to about 1:6.5, for example, or about 1:6. A non-ionic de-oiling agent may then be added to the machine (301) in a ratio of about 2 grams per liter of water. The non-ionic de-oiling agent removes excess oil from the second staple fibers which may have been obtained during the fiber extrusion, crimping and/or cutting process. In some embodiments, the de-oiling agent may reduce the amount of oil in the second staple fibers to about 0.05 to about 0.1% by weight. Elimination (or reduction) of excess oil helps facilitate dye uptake during the dyeing process.

The dyeing process may begin by increasing the temperature of the bath (i.e., the combination of the second staple fibers and the water in the selected weight ratio) from room temperature to a temperature above the glass transition temperature (Tg) of the cationic dyeable polyester material of the second staple fibers (302). In some embodiments, the Tg of the cationic dyeable polyester material may be about 70° C. to about 85° C., and the temperature of the bath may be increased to about 95° C. at the maximum gradient achievable by the dyeing machine. As used herein, "increasing the temperature at a maximum gradient" and like descriptions refer to increasing the temperature of the bath to the desired temperature over the shortest time period achievable by the dyeing machine. The machine is then allowed to run for about 20 minutes, to complete the de-oiling process (303).

Then, the water is drained and re-filled to the same weight ratio used in the de-oiling process, e.g., about 1:5.5 to about 1:6.5, or about 1:6. A dispersing agent may then be added as well as the desired cationic dyestuff and a pH adjusting agent (e.g., acetic acid) (304). The dispersing agent may be added to the bath in any suitable amount, for example, about 2 grams per liter. The dispersing agent may be any suitable dispersing agent used in cationic polyester dyeing procedures. Similarly, the cationic dyestuff may be any cationic dyestuff suitable for dyeing cationic polyester staple fibers. Those of ordinary skill in the art would be readily capable of selecting a suitable dispersing agent and cationic dyestuff for this process based on the desired color of the second staple fibers. The pH adjusting agent (e.g., acetic acid) is added in order to maintain the pH of the dye bath between about 4.5 and 5.5, in order to facilitate suitable or optimal conditions for dye uptake. The temperature of the machine is then increased at the maximum gradient achievable by the machine (for example at a rate of about 0.7° C. to about 1.3° C. per minute, or about 1° C. per minute) until it reaches 100° C. in order to structurally open the fibers above their glass transition temperature (Tg), thereby exposing the maximum number of dye sites for dye uptake (305). The machine is then run for about 20 minutes (306). Then the temperature of the machine is further increased to about 125° C. at a steady rate of about 0.5° C. per minute to about 1° C. per minute, for example, about 0.8° C. per minute (307). Once the temperature reaches about 125° C., the machine runs for another period of time of about 45 minutes (308). Then the temperature is reduced by about 1.0° C. per minute, until the temperature reduces to a temperature below the Tg of the second staple fibers, for example, a temperature of about 80° C. (309). The second staple fibers regain their closed structure, thus trapping the dyestuffs inside the fibers. The bath liquid is then drained, and the dyeing process completed.

The machine may then be re-filled with water (to the same ratio as used in the de-oiling and dyeing processes) at a temperature of about 25° C. to about 35° C., for example about 30° C. to being a cool rinsing process. The machine runs for about 3 minutes to about 10 minutes, for example about 5 minutes (310), before the water is drained. This rinsing cycle may be repeated as desired (310).

Then the machine is once again re-filled with water (to the same ratio as used in the de-oiling and dyeing processes) at a temperature of about 25° C. to about 35° C., for example about 30° C., and a pH adjusting agent (e.g., acetic acid) is added to adjust the pH to about 5.5 to about 6.0. The machine may then run for another period of time sufficient to effect pH adjustment, for example about 5 to about 7 minutes, or about 5 minutes (311).

According to some embodiments, the staple fibers may be subjected to an anti-static fiber finishing process. Since dyeing of the second staple fibers includes removal of oil to facilitate dye uptake, the resulting dyed fiber has a low oil content. In addition, the dyeing process can cause shrinkage of the fibers, which results in rougher surfaces and higher coefficients of friction. Because polyester fibers are synthetic, a low oil content and high coefficient of friction tend to generate undesirable static during fiber mixing, carding, drawing and spinning processes when the fibers rub against each other or against the metal parts of the machinery. Such high static buildup causes the fibers to stick on the cylinders of the carding machine during the carding process. As a result, slivers are often not formed properly, which makes the subsequent drawing and spinning process difficult if not impossible. To address this problem, according to embodiments of the present disclosure, an anti-static softener may be added to the second staple fibers after the dyeing process to achieve a desired mass resistivity of about $8.0\times10^{6}$ Ω·m to about $4.0\times10^{8}$ Ω·m and oil content of about 0.12 to 0.25% by weight.

To achieve these parameters, an anti-static softener may be added to the machine after the pH adjustment process. Any suitable anti-static softener may be used, and those of ordinary skill in the art would be readily capable of selecting a suitable anti-static softener. The anti-static softener may be added in any suitable amount, for example about 10 grams per liter. After adding the anti-static softener, the temperature of the machine may be increased to about 50° C. at the maximum gradient achievable by the machine (312), and the machine may then run for another period of time sufficient to achieve the desired mass resistivity and oil content. For example, the machine may run for about 24 to about 26 minutes, or about 25 minutes (313). The liquid is then completely drained.

Conventional black and other color heather polyester fabrics available on the market are colored by dyeing greige fabrics after the knitting process. In contrast, according to embodiment of the present disclosure, the staple fibers themselves are colored prior to the knitting process, yielding significant water savings in the dyeing process, and enabling the manufacture of heather effects with three or more colors. For example, as noted above, the conventional process of dyeing already knitted fabrics or textiles is normally carried out in an overflow jet dyeing machine which requires a liquid ratio of 1:10 to 1:20. This means that every 1 kilogram of fabric requires 10 to 20 kilograms of water for the dyeing process. However, according to embodiments of the present invention, the fiber dyeing method requires a drastically reduced amount of water. For example, according to embodiments of the present invention, the fiber dyeing method requires a fiber to liquid weight ratio of about 1:5.5 to about 1:6.5, or about 1:6. This means that every 1 kilogram of fibers only requires about 5.5 to about 6.5, or about 6 kilograms of water for the dyeing process.

Additionally, according to some embodiments of the present disclosure, the heather fabric is made by blending first staple fibers that are masterbatch dyed, and second staple fibers that are dyed using a cationic dyestuff bath. In these embodiments, only 50% of the fibers in the resulting heather fabric are bath dyed (with the balance being masterbatch dyed). As such, the amount of water needed to color 1 kilogram of fabric is only about 2.75 to about 3.25, or about 3 kilograms (instead of about 5.5 to about 6.5, or about 6 kilograms) since only 50% of the fibers in the fabric need to be bath dyed. In contrast, using the conventional heather dyeing technique, a fabric with only 50% of its fiber needing to be dyed still requires the same liquid ratio of 1 kilogram fabric to 10 to 20 kilograms liquid because the liquid weight is based on the weight of the knitted fabric, and not on the weight of fibers that need to be dyed. Therefore, comparing two heather fabrics having the same knitting structure and weight, both of which have 50% of the fibers or fabric that need to be dyed, the amount of water required by a method according to embodiments of the present invention in which the fiber/liquid ratio is 1:6 is only about 15% to about 30% of that that required by the conventional method (depending on the liquid ratio used in both processes). This represents a marked water savings of about 70% to about 85%.

According to embodiments of the present disclosure, once the fiber dyeing and finishing processes are completed, the dyeing basket may be taken out of the dyeing machine and loaded into a hydro-extractor. The hydro-extractor rotates at 800 revolutions per minute for around 40 minutes to remove excess water from the fibers. The water content of the fibers may be controlled to between 25 and 30% by weight, so as to avoid excessive loss of the anti-static softener through water extraction, which would affect the anti-static property of the finished fibers. The dyed cationic (in some embodiments black) second staple fibers are then taken out of the dyeing basket and placed on a conveyor belt of a steam dryer that runs at about 5 meters per minute at a temperature of 120° C./248° F. The steam dried cationic dyed (in some embodiments black) second staple fibers are then loaded into a trolley for color checking and testing of color fastness properties prior to the subsequent yarn formation process.

Referring back to FIG. 1, when the cationic dyed second staple fibers are ready, a heather yarn can be produced. First, the first staple fibers (e.g., the non-carbon black pigment colored polyester staple fibers) and the second staple fibers (e.g., black cationic dyed polyester staple fibers) may go through a fiber opening process. Each color of fiber intended for the heather yarn is opened from a highly compressed bale to give loose fibers. Then, the different fibers are sucked into a fiber mixing machine that mixes the fibers homogeneously according to the desired color recipe, i.e., the machine sucks in a specific percentage by weight of each color fiber based on the recipe (206). The mixed fibers may then go through a carding process in which the fibers are mechanically combed to remove contaminants and to align the staple fibers to form loose slivers (207). Multiple slivers are then fed into a sliver mixing machine to form finer rovings (208). The rovings are then fed into a spinning frame where they are drawn and twisted to form heather spun yarns (209). Any suitable spinning technique may be used, non-limiting examples of which include ring spinning, open end spinning, siro spinning, siro compact spinning, etc. . . . The heather yarn produced by methods according to embodiments of the present disclosure may include 2 or more colors, or 3 or more colors, which is not achievable by the conventional methods. Indeed, even in methods that combine conventional masterbatch dyed fibers colored with a carbon black based dye with raw white polyester fibers, the resulting heather fabric can only have 2 colors, i.e., the color of the masterbatch dyed fibers, and the color taken up by the raw fibers during the fabric dyeing process. In contrast, there is theoretically no limit to the number of colors that can be used to create heather yarns according to embodiments of the present disclosure.

Additionally, the heather yarns according to embodiments of the present disclosure can have low thermal buildup as they do not contain carbon black or carbon black derived pigments. The heather yearns according to embodiments of the present disclosure are also substantially bleed-free, i.e., they exhibit little to no bleeding due to the use of second fibers dyed with a cationic dyestuff and first fibers that are masterbatch dyed, neither of which sublimates under high temperature conditions during normal screen printing processes.

In some embodiments of the disclosure, a knitted heather fabric includes a plurality of the spun heather yarns knitted together to form the knitted heather fabric. Because the staple fibers used to form the spun heather yarn are all polyester, the knitted heather fabric may be 100% polyester. In some embodiments, however, the spun heather yarns disclosed herein can be combined with other materials (e.g., Spandex) to form the knitted heather fabric. According to some embodiments, to create a heather effect with more than two colors, a knitted heather fabric may include a plurality of the spun heather yarns having first, second and third (and/or fourth) pre-colored staple fibers knitted together to form the knitted heather fabric.

To produce knitted fabrics (210), the heather yarns may be fed into either a weft or warp knit machine in the form of bobbin or warp beams for knitting. Spandex yarns can also be incorporated into the fabric during the knitting process to give the knitted fabric higher elongation and good recovery properties. Once the knitting is finished, the fabric may go through a rinsing process (211) to remove contaminants and oil that may have been obtained during the spinning and knitting processes. After this rinsing, the fabric may be heat set to stabilize its dimensions and physical properties (212). During the heat setting process, additional chemical agents can be padded onto the fabric to achieve as desired function or performance characteristic. Nonlimiting examples of such chemical agents include wicking agents, soil release agents, anti-static agents, anti-odor agents, anti-microbial agents, ultra-violet protection agents, cooling agents, etc. to achieve specific desirable functional performance.

After the heat setting process, the knitted fabric is completed. Since cationic dyestuffs form strong ionic bonds with the dyeable cationic polyester materials of the second staple fibers, and because the masterbatch pigment colorant is incorporated into the first staple fibers during extrusion, the finished fabric has superb colorfastness. For example, in some embodiments, color fastness to dry heat (AATCC 117), color fastness to washing (AATCC 61-2A) and color fastness to dye transfer (AATCC 160) of the fabrics all achieve a grade of 4.5 or above.

According to some embodiments, the heather knitted fabric may be used to make articles of clothing or apparel. Those of ordinary skill in the art would be readily capable of using the heather fabrics disclosed herein to make articles of clothing or apparel. In some embodiments, when the heather fabrics disclosed herein are made into articles of clothing or apparel that require screen printing (such as, for example, a tee shirt), the shirt will go through printing, flashing & curing (common steps in screen printing an article of clothing). First, the shirt may be put onto a printing board where it may be affixed and screen printed either by a hand squeegee or an automatic squeegee. Once the article is printed with a plastisol ink, the shirt is placed under a flash dryer (i.e., a high wattage output infrared device that helps to quickly solidify the ink within seconds with high heat). The temperature needed to cure most plastisol inks on polyester articles of clothing (e.g., polyester tee shirts) is usually around 300° F. to 320° F., and the article of clothing is typically exposed to that heat for about 5 to a maximum of 10 seconds. If the print design has two colors, the tee may need to be printed and flashed a second time. If the print design has more than two colors, the tee may need to be printed and flashed an additional time for each additional color (e.g., a three-color print design may need three printing and flashing procedures, etc.). After the last flash, the shirt is removed from the printing board and placed on a conveyor belt of an infrared curing machine with the printed side facing upward. The shirt will then go through an enclosed infrared heating chamber for around 1 minute to completely cure the plastisol ink on the fabric. The temperature of the infrared heating chamber is typically set between 320° F. to a maximum of 340° F. for polyester articles of clothing or apparel (e.g., tee shirts).

Since the fabrics according to embodiments of the present disclosure include second polyester staple fibers dyed with a cationic dyestuff, the strong ionic bond formed between the cationic dyestuff molecules and the second staple fibers generally do not break up when exposed to the flashing and curing temperatures experienced during screen printing. Thus, little to no dye migration occurs during screen printing. Additionally, the pigment in the first polyester staple fibers that are masterbatch dyed during extrusion generally do not sublimate by nature, so again, little to no dye migration occurs during the screen printing process. As a result, according to embodiments of the present disclosure, the heather fabric can achieve a grade of 4.5 on the color fastness to dry heat test (AATCC 117). Accordingly, the heather fabrics according to embodiments of the present disclosure "bleed-free." As used herein, the term "bleed-free" refers to the color fastness of the heather fabrics achieving a grade of 4.5 or better on the color fastness to dry heat test (AATCC 117). In contrast, in articles of clothing (e.g., tee shirts) made with heather fabrics currently available on the market (e.g., those made by combining masterbatch dyed polyester fibers and normal white polyester fibers, and dyed after knitting), the disperse dyestuff sublimates during the flashing and curing procedures of the screen printing process. As such, those conventional fabrics are undesirable for screen printing.

In sum, as shown in FIG. 1, a process of making a heather spun polyester yarn according embodiments of the present invention includes mixing raw normal polyester (PET) chips with a pigment masterbatch and dehydrating the mixture to remove excess water content (201). Then, colored filaments are extruded at 260° C. to 285° C., and the filaments are oiled and drawn to impart strength and achieve a yarn size of 1.5 denier or lower (202). Next, the colored filament yarn may be textured to impart bulkiness, porosity, softness and/or elasticity (203). The colored, textured filaments are then crimped and cut into first staple fibers having a size of 38 mm to 52 mm (204).

Then, high $SO_3^-$ content cationic dyeable polyester staple fibers are dyed with a cationic dyestuff using a fiber bath dye method to make second stable fibers (205). The first and second staple fibers are then mixed at a specific weight percentage to create heather fibers of two or more colors (206). The heather fibers are then carded to form heather slivers (207), and multiple heather slivers are combined to form heather rovings (208). The heather rovings are then spun to form spun heather yarn (209), and the spun heather yarn is knitted to form a spun heather fabric (210). The spun heather fabric may then be rinsed and de-oiled (211), and then heat set using chemical agents to complete the finished heather fabric (212). The completed heather fabric can then be formed into an article of clothing, and screen printed (if desired).

While certain exemplary embodiments of the present disclosure have been illustrated and described, those of ordinary skill in the art will recognize that various changes and modifications can be made to the described embodiments without departing from the spirit and scope of the present invention, and equivalents thereof, as defined in the claims that follow this description. For example, although certain components may have been described in the singular, i.e., "a" surfactant, "a" pigment, and the like, one or more of these components in any combination can be used according to the present disclosure.

Also, although certain embodiments have been described as "comprising" or "including" the specified components, embodiments "consisting essentially of" or "consisting of" the listed components are also within the scope of this disclosure. For example, while embodiments of the present invention are described as including a combination of first and second pre-colored staple fibers, a spun polyester yarn consisting essentially of or consisting of first and second pre-colored staple fibers is also within the scope of this disclosure. Accordingly, the spun polyester yarn may consist essentially of the first and second pre-colored staple fibers. In this context, "consisting essentially of" means that any additional components in the spun polyester yarn will not materially affect the ability of the ability of the staple fibers to be spun into the yarn, or the ability of the yarn to be knitted into a fabric or textile.

As used herein, unless otherwise expressly specified, all numbers such as those expressing values, ranges, amounts or percentages may be read as if prefaced by the word "about," even if the term does not expressly appear. Further, the word "about" is used as a term of approximation, and not as a term of degree, and reflects the penumbra of variation associated with measurement, significant figures, and interchangeability, all as understood by a person having ordinary skill in the art to which this disclosure pertains. Any numerical range recited herein is intended to include all sub-ranges subsumed therein. Plural encompasses singular and vice versa. For example, while the present disclosure describes "a" pigment or "a" surfactant, a mixture of such pigments or surfactants can be used. When ranges are given, any endpoints of those ranges and/or numbers within those ranges can be combined within the scope of the present disclosure. The terms "including" and like terms mean "including but not limited to," unless specified to the contrary.

Notwithstanding that the numerical ranges and parameters set forth herein may be approximations, any numerical value inherently contains certain errors necessarily resulting from the standard variation found in their respective testing measurements. The word "comprising" and variations thereof as used in this description and in the claims do not limit the disclosure to exclude any variants or additions.

What is claimed is:

1. A spun heather yarn, comprising:

first pre-colored staple fibers comprising masterbatch-dyed first polyester fibers, and second different pre-colored staple fibers comprising second polyester fibers dyed with a cationic dyestuff, the first and second pre-colored staple fibers having a size lower than 2.0 denier and being spun together to form the spun heather yarn.

2. The spun heather yarn of claim 1, further comprising third different pre-colored staple fibers comprising third polyester fibers that are either masterbatch-dyed or dyed with a cationic dyestuff, and wherein the third different pre-colored staple fibers are spun together with the first pre-colored staple fibers and second different pre-colored staple fibers to form the spun heather yarn.

3. A knitted heather fabric comprising a plurality of the spun heather yarns according to claim 1 knitted together to form the knitted heather fabric.

4. The knitted heather fabric of claim 3, wherein the knitted heather fabric is 100% polyester.

5. A knitted heather fabric comprising a plurality of the spun heather yarns according to claim 2 knitted together to form the knitted heather fabric.

6. The spun heather yarn according to claim 1, wherein the first pre-colored staple fibers are substantially free of carbon black and carbon black derivatives.

7. The spun heather yarn according to claim 1, wherein the first pre-colored staple fibers are a color other than black.

8. The spun heather yarn according to claim 1, wherein the second different pre-colored staple fibers are black in color.

9. The spun heather yarn according to claim 1, wherein the first pre-colored staple fibers are a color other than black, and the second different pre-colored staple fibers are black in color.

10. An article of clothing, comprising the knitted heather fabric of claim 3.

11. The article of clothing according to claim 10, wherein the article of clothing is substantially free of carbon black and carbon black derivatives.

12. The article of clothing according to claim 11, wherein the article of clothing is configured to directly contact a wearer's skin.

13. The article of clothing according to claim 10, wherein the article of clothing is configured to directly contact the skin of a wearer.

* * * * *